United States Patent [19]

Carroll

[11] Patent Number: 4,906,824

[45] Date of Patent: Mar. 6, 1990

[54] CASH REGISTER HOOD

[75] Inventor: Francis A. Carroll, Dublin, Ireland

[73] Assignee: Carroll Products and Designs Limited, Dublin, Ireland

[21] Appl. No.: 236,758

[22] Filed: Aug. 26, 1988

[30] Foreign Application Priority Data

Aug. 25, 1987 [IE] Ireland ..... 2316/87
Dec. 8, 1987 [IE] Ireland ..... 2316/87

[51] Int. Cl.[4] ..... G06C 5/02; G07G 1/00

[52] U.S. Cl. ..... 235/1 R; 235/2; 235/4; 235/7 R; 312/23; 312/108; 312/130; 312/211; 312/265.6

[58] Field of Search ..... 235/1 R, 1 D, 1 E, 2–7 A, 235/145 R; 312/23, 107, 108, 117, 119–121, 126, 127, 130, 211, 257 A, 257 R, 100

[56] References Cited

U.S. PATENT DOCUMENTS

| | | | |
|---|---|---|---|
| 2,941,713 | 6/1960 | Zipf | 235/6 |
| 3,645,594 | 2/1972 | Cintz | 312/100 |
| 4,031,357 | 6/1977 | Brand | 235/7 A X |
| 4,186,477 | 2/1980 | Cary et al. | 235/7 R X |
| 4,386,264 | 5/1983 | Homer | 235/7 R X |
| 4,719,337 | 1/1988 | Hudson et al. | 235/7 R |

*Primary Examiner*—B. R. Fuller
*Attorney, Agent, or Firm*—Bernard, Rothwell & Brown

[57] ABSTRACT

A cash register hood comprises a front panel 110, two side panels 112 and an overhead panel or tray 116. The hood is fitted to a base board 118 which is fixed to a counter-top. The hood may be assembled using keys 125 and slots 126 integrally formed on the panels. The cash register hood also includes a product display panel 116 and a shelf 117. Trays 32,33 and product dispensers 50 may be attached to the hood as required.

18 Claims, 8 Drawing Sheets

CASH REGISTER HOOD

The present invention relates to cash register hoods.

Cash registers which operate on the basis of mechanical or electro-mechanical systems, i.e. using gears, tumblers, electric motors etc., are invariably quite large, heavy and sturdy. In recent years, cash registers which operate using electronic circuitry have become very popular. An advantage associated with the use of electronic circuitry is that it has been possible to produce cash registers which are much smaller in size than heretofore. However, associated with this advantage is a corresponding disadvantage in that these "electronic cash registers" are relatively light weight and not as sturdy as the mechanical type cash registers. Thus people can unintentionally damage an electronic cash register by leaning on it or placing money or change on top of the cash register. A further problem which has manifested itself with electronic cash registers is that because they are so light, thieves have been known to simply lift cash registers off store counters and run from the stores with the cash registers.

The object of the present invention is to attempt to alleviate the above disadvantages associated with the use of electronic cash registers.

The prior art in respect of this invention is exemplified by the following patent specifications:

(1) U.S. No. 3,645,594-Cintz
(2) GB No. 2175195A-International Computers Ltd
(3) GB No. 2115272A-Durst (UK) Ltd
(4) GB No. 1509113-Architectural Products Ltd
(5) GB No. 1414085-Siemens
(6) GB No. 1293826-Skinner
(7) GB No. 1228231-Standard Telephones and Cables Ltd The present invention provides a cash register hood comprising a front panel, two side panels and an overhead panel, said panels having first complementary engaging means which enable the panels to be readily engageable and disengageable with one another, so as to form, when engaged, a security enclosure for a cash register which prevents access to the cash register from the rear and sides while allowing ready access from the front thereof.

Advantageously the cash register includes a base board removably engageable with the panels and which is adapted to be fixed to a supporting surface, such as a counter-top.

Preferably, the overhead panel includes a tray having one or more depressions integrally formed therein for supporting items such as money, tickets, small purchases, etc.

Conveniently, at least the front panel is made from a transparent plastics material.

Advantageously, the first complementary engaging means comprise a plurality of keys and slots integrally formed on said panels.

Preferably, the front panel and overhead panels are provided with keys at the sides thereof and the side panels are provided with the complementary slots.

Advantageously, the cash register hood includes at least one receptacle removably engageable with said panels on either the interior or exterior surface of the hood, the or each receptacle and panels having second complementary engaging means.

Preferably, the second complementary engaging means comprise lips and slots formed on the or each receptacle and panels.

Conveniently, at least one receptacle is in the form of a tray and also at least one receptacle may be in the form of a container with dispensing means.

The invention also provides a cash register hood comprising a front panel, two side panels and an overhead panel, the hood being adapted to accommodate a cash register within said panels, the hood further comprising product display means.

Preferably, the cash register hood includes product dispensing means.

Advantageously, a portion of the front panel is transparent and the product display means is located behind said transparent portion of the front panel and within the hood.

Preferably, a product dispensing means in the form of a shelf is located behind the product display means.

Conveniently, the product dispensing means comprises a receptacle removably attached to the panels and the receptacle is removably attached to the exterior of the hood.

Advantageously, a product dispensing means is located above the overhead panel and supported at each end by extensions of the side panels.

The invention further provides a cash register hood comprising a base having means to enable the hood to be secured to a supporting surface, a front panel and two side panels fixed to the base, and an overhead panel fixed to the front and side panels, the panels and base defining an enclosure for accommodating a cash register, the overhead panel having one or more depressions integrally formed therein for supporting items such as money, tickets, small purchases etc.

The term "cash register" as used in this specification and claims is hereby defined as applying to all transaction recordal devices which might be used to record a transaction between a purchaser and a seller.

The invention will hereinafter be more particularly described with reference to the accompanying drawings which show, by way of example only, three different embodiments according to the invention. In the drawings.

Figure 6A:
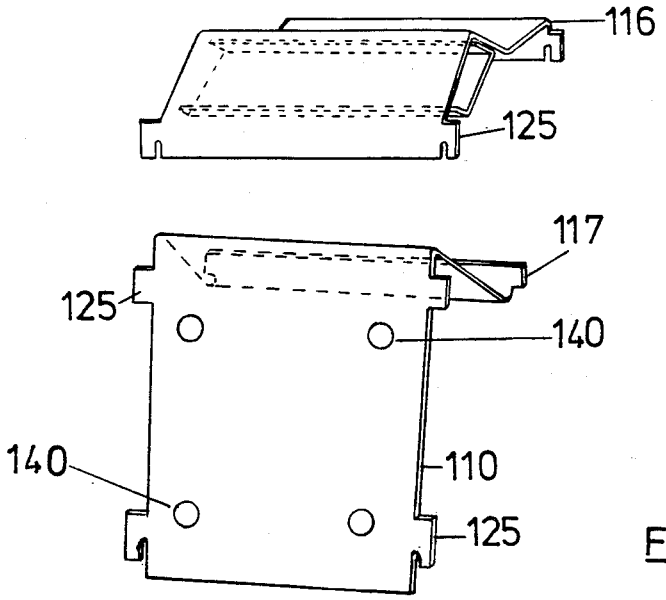
FIG. 6 is a side view of the second embodiment with a cash register shown within the cash register hood.

FIG. 6*a* is a perspective view of the individual components of the product dispensing shelf and product display panel of the second embodiment.

Figure 7:
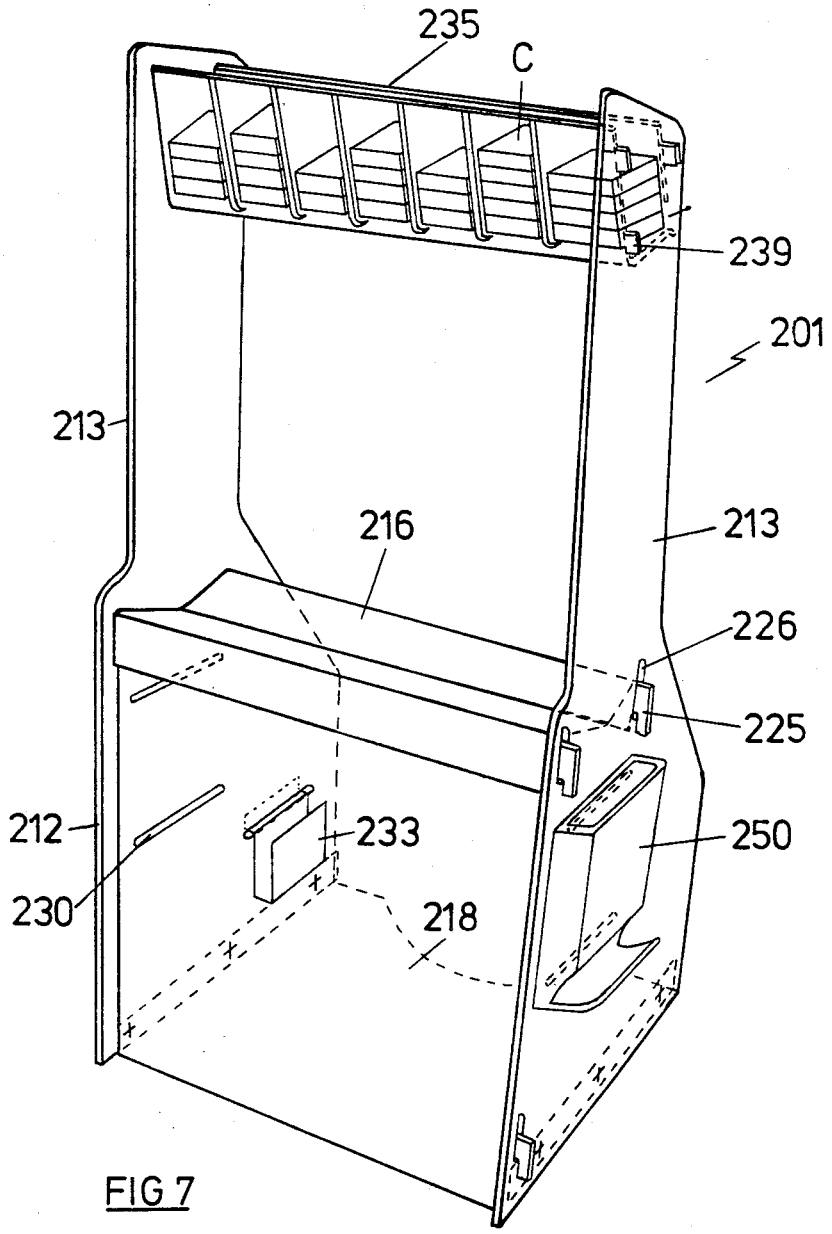
Figure 7A:
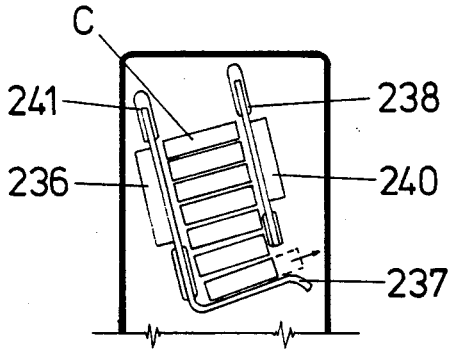

FIG. 7 is a perspective view of a third embodiment of cash register hood according to the invention with a product dispenser located above the upper panel or tray;

FIG. 7*a* is a side view of the product dispenser and

Figure 7B:
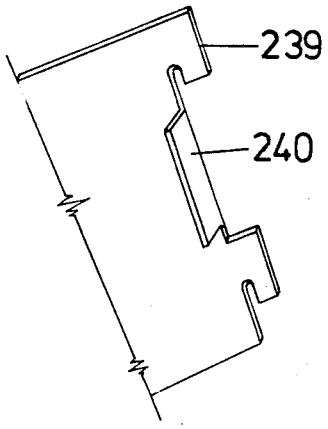

FIG. 7*b* is a perspective view of a detail of keys for connecting the product dispenser to the side walls of the cash register hood.

Referring to the drawings, and initially to FIGS. 1 to 4 in respect of the first embodiment 1 of cash register hood, which comprises a front panel 10, two side panels 12 and a top panel 14 incorporating a tray 16, and a base board 18.

The tray 16 is provided with a valley 19 on its upper surface which can be used by a customer to place money tendered or by a shop assistant to hold the customer's change. The side panels 12 are connected to upstanding lips 20 of the base board 18 by removable fasteners 21 and the base board 18 is fixed to a counter top by screws 22. The front panel 10 and tray 16 are provided with keys 25 which engage in complementary slots 26 in the side panels 12. The slot 26*a* in the upper corner of each side panel is large enough to accommodate two keys 25, one from the front panel 10 and the other from the tray 16.

Figure 1:
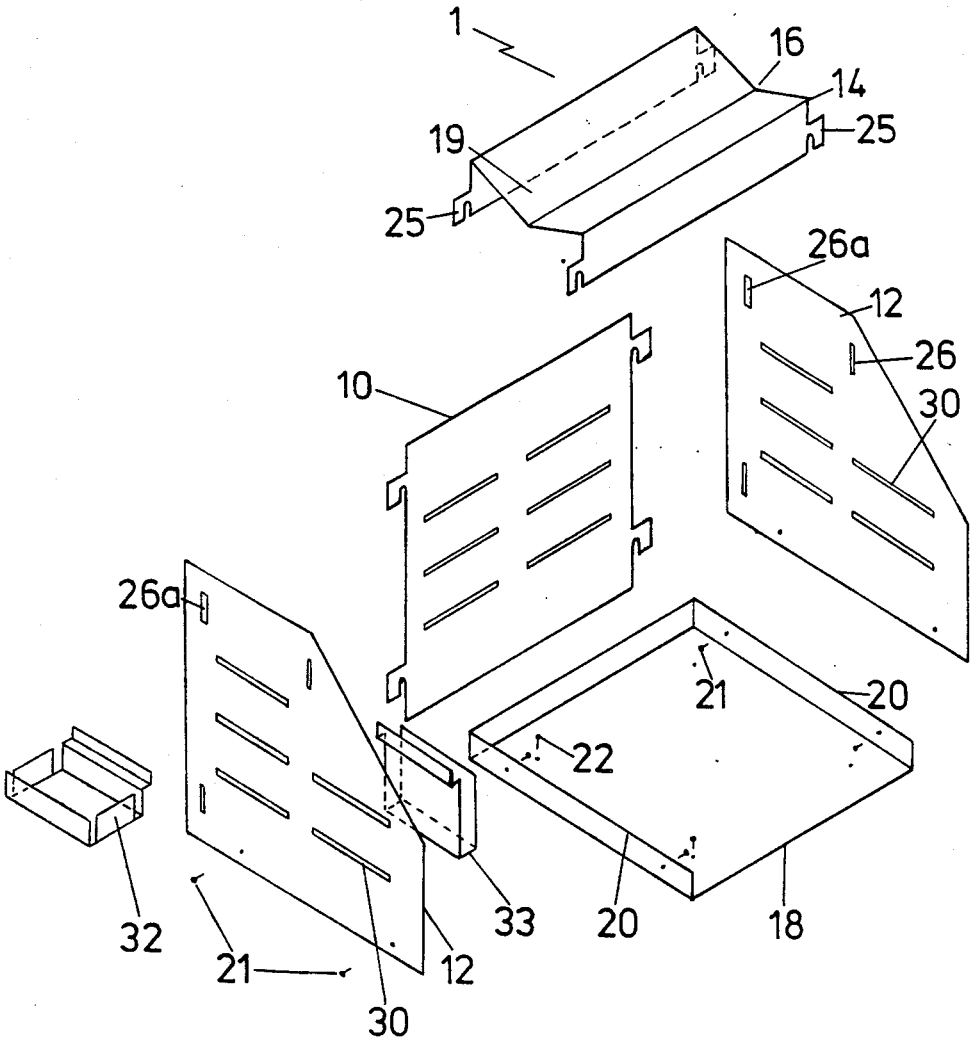
FIG. 1 is an exploded perspective view of the first embodiment of cash register hood.
Figure 2:
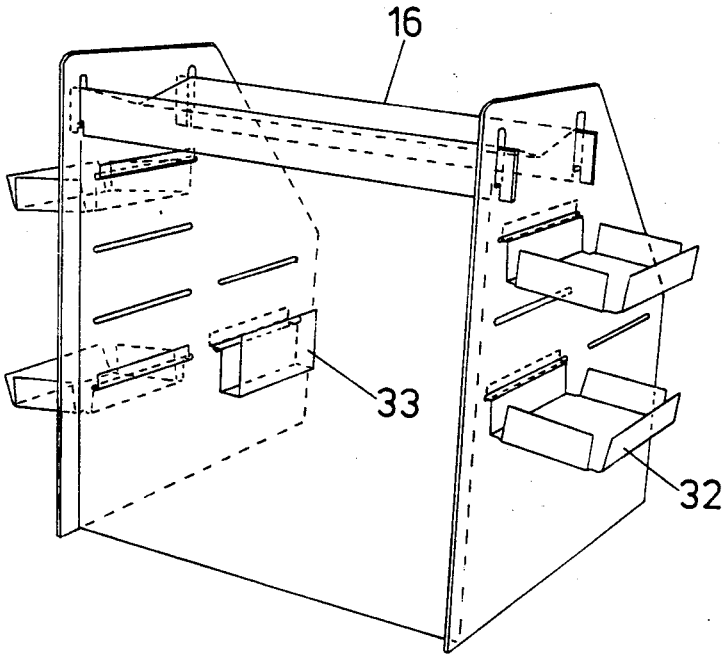
FIG. 2 is a perspective view of the first embodiment with a number of trays attached to the side walls of the cash register hood.

Each of the side panels 12 has a number of horizontally disposed slots 30 into which can be inserted the upstanding lip 31 of either an enclosed tray 32 or an open-sided tray 33. When the lip 31 of a tray 32 or 33 is engaged with a slot 30, the tray will be supported in the manner as shown in FIG. 2 and may be used for displaying small products for sale or for retaining dockets, vouchers, receipts or the like. In most instances, the trays 33 would be located on the inside of the hood 1 for use by a shop-assistant. As shown only in FIG. 1, the front panel 10 may also be provided with the slots 30.

All the elements of the cash register hood, with the exception of the base board 10 are manufactured from a transparent, acrylic plastics material. The base board 10 is made from a coated sheet metal or a polyvinylchloride (PVC) plastics material.

Figure 3:
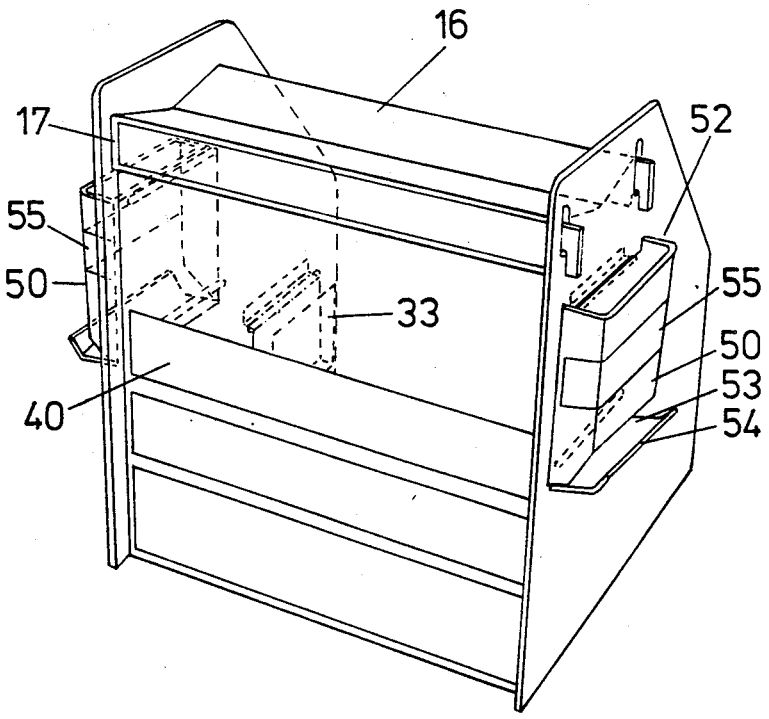
FIG. 3 is a perspective view of the first embodiment with a product dispensing unit attached to each side wall and advertising panels provided on the front.

The cash register hood may also be fitted with additional features as shown in FIG. 3. Advertising panels 40 may be affixed to the front panel 10 or the outwardly facing lip 17 of the tray 16 while leaving an area clear for sight of the display panel of a cash register. A product dispensing unit 50 may optionally be attached to, and supported from a slot 30 in the side panels 12. The product dispensing unit 50 comprises a container body 51 open at its top 52 and bottom 53. A shelf 54 is located at the opening 53 to support products or merchandise which is put into the container 51 at the top 52 and removed as required from the bottom 53 by a customer. An advertising panel or label 55 is fixed to each dispensing unit 50 as required.

Figure 4:
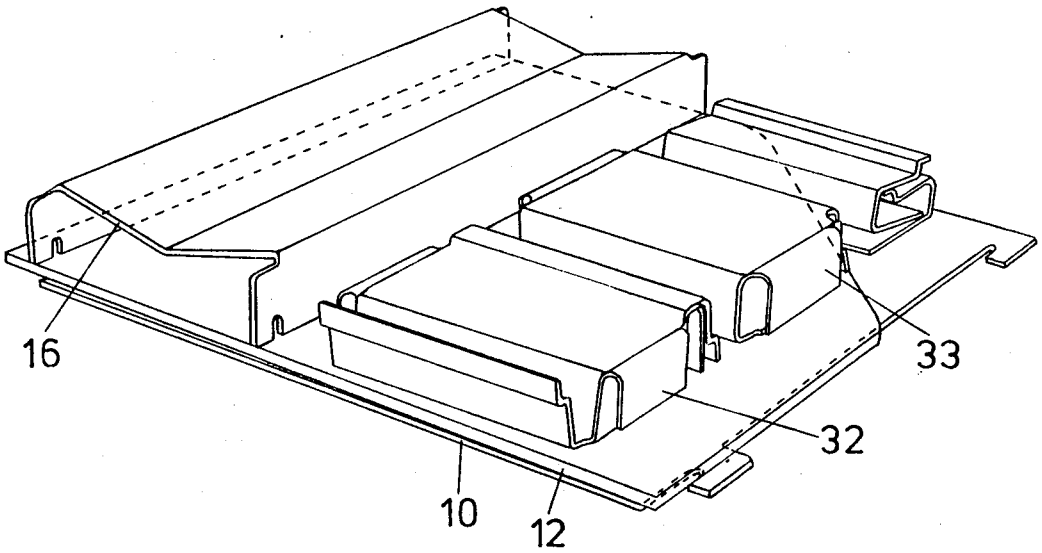
FIG. 4 is a perspective view of the first embodiment disassembled and ready for packaging.

As shown in FIG. 4, the elements of the cash register hood 1, prior to assembly, occupy very little volume in comparison to the assembled unit. Therefore, the elements of the case register hood 1 may be packaged in a flat pack, thus giving the benefit of low packaging costs and low transport costs per unit.

Figure 5:
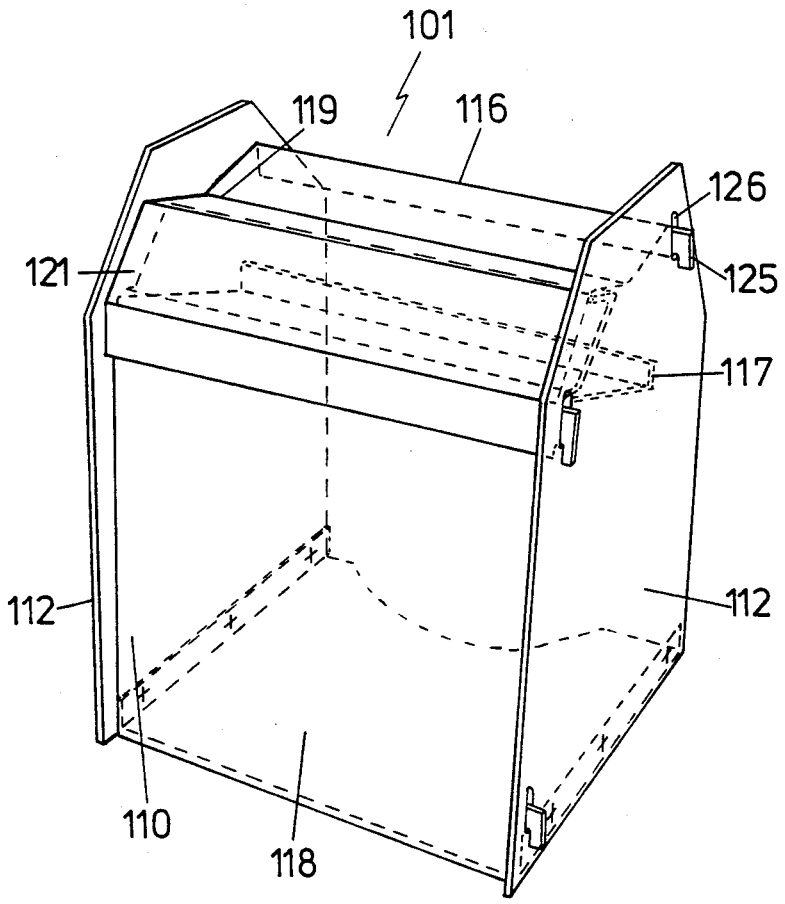
FIG. 5 is a perspective view of a secoond embodiment of cash register hood having a shelf located underneath the upper panel or tray and a product display panel.

The second embodiment of cash register hood 101 will now be described with reference to FIGS. 5 to 6*a* of the drawings. The second embodiment 101 includes the following elements common to the first embodiment 1, namely two side panels 112 and a base board 118. The second embodiment also includes a modified tray 116 and a modified front panel 110 having a product dispensing shelf 117 integrally formed therewith.

The modified tray 116 has a valley 119 on its upper surface for accommodating change and a display panel 121 mechanically fixed in position so as to retain a product B for permanent display e.g. cigarette packets, films, etc. The panel 121 may be removed, without disassembling the cash register hood, to allow the display to be changed. Units of the product B displayed on the panel 121 may be stored on the shelf 117 and may be dispensed by a shop assistant as requested by a customer. Alternatively, the shelf 117 may be used by the shop-assistant to store documents etc.

The second embodiment 101 is assembled in similar fashion to the first embodiment 1 with keys 125 engaging with slots 126 in the side panels 112. Slots 130 are also provided in the side panels 112 for supporting trays 32 and 33 (as shown in the drawings of the first embodiment 1). FIG. 6 illustrates how cash register A is located in the cash register hood 101.

Figure 6:
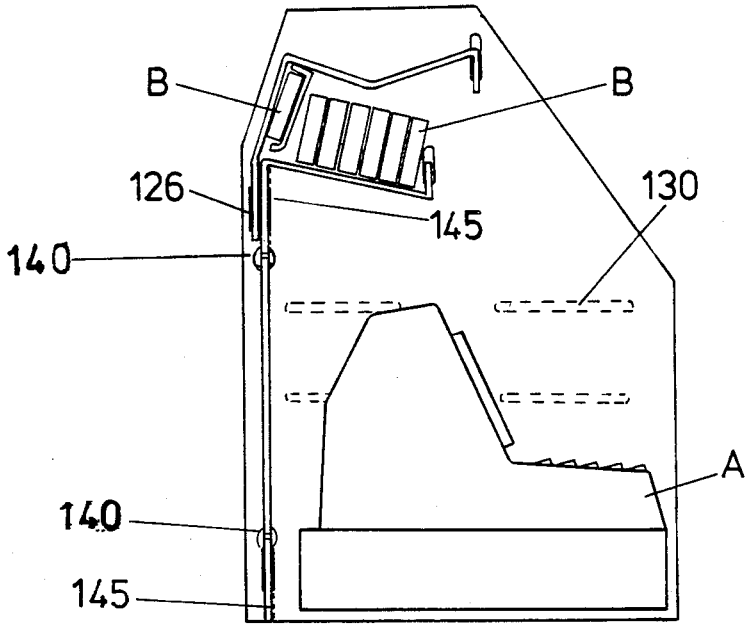

FIGS. 6 and 6*a* illustrate four buttons 140 provided in the front panel 110. The buttons 140 are used to retain advertising cards 145 in position within the cash register hood.

FIGS. 7, 7*a* and 7*b* illustrate the third embodiment of cash register hood 201 according to the invention. This embodiment also includes some elements common to the first embodiment, i.e. a tray 216 and a base board 218. Each of the two side panels 212 has an integrally formed support 213 which extends above the tray 216 to support a product dispenser 235.

Forming the product dispenser 235 are a rear wall 236, incorporating a shelf 237 and a separate front wall 238. The rear wall 236 and the front wall 238 are each provided with two keys 239 at each end. As shown in FIGS. 7*a* and 7*b* a tab 240 is provided between each pair of keys 239 and provides additional support. The keys 239 engage with complementary slots 241 in the supports 213. The product dispenser 235 is divided into compartments for stocking units of the product C which are dispensed by the shop assistant as required.

Assembly of the third embodiment 201 is similar to the assembly of the first embodiment with keys 225 being engaged with the slots 226. The side panels 212 also include slots 230 which can be used to support trays 233 (trays 32 as shown in the drawings of the first embodiment) and product dispensing units 250.

In the three embodiments described, the dimensions of the cash register hoods may be selected on the basis of a store's requirements and the dimensions of the brand of cash register. Also, cash register hoods can be constructed to accommodate more than one cash register. The cash register hoods of the invention are made from a transparent acrylic plastics material which does not prevent a customer from seeing the display screen of the cash register which indicates the amount of money a customer is charged for his purchase.

The side panels of the cash register hoods of the invention may be manufactured from an opaque plastics material without interfering with the view of the cash register display through the front panel.

I claim:

1. A cash register hood comprising a front panel, two side panels and an overhead panel, said panels having first complementary engaging means which enable the panels to be readily engageable and disengageable with one another, so as to form, when engaged, a security enclosure for surrounding a rear, a top, and sides of a cash register to prevent access to the cash register from the front, the top and the sides while leaving a front of the cash register exposed to allow ready access from the front thereof.

2. A cash register hood as claimed in claim 1, which includes a base board removably securable to the panels and which is adapted to be fixed to a supporting surface, such as a counter-top.

3. A cash register hood as claimed in claim 1, in which the overhead panel includes a tray having one or more depressions integrally formed therein for supporting items such as money, tickets, small purchases, etc.

4. A cash register hood as claimed in claim 1, in which at least the front panel is made from a transparent plastics material.

5. A cash register hood as claimed in claim 1, in which the first complementary engaging means comprise a plurality of keys and slots integrally formed on said panels.

6. A cash register hood as claimed in claim 5 in which the front panel and overhead panels are provided with keys at the sides thereof and the side panels are provided with the complementary slots.

7. A cash register hood as claimed in claim 1, including at least one receptacle removably engageable with said panels on either an interior or exterior surface of the hood, the at least one receptacle and the panels having second complementary engaging means.

8. A cash register hood as claimed in claim 7, in which the second complementary engaging means comprise lips and slots formed on the at least one receptacle and panels.

9. A cash register hood as claimed in claim 7, in which at least one receptacle forms a tray.

10. A cash register hood as claimed in claim 7, in which at least one receptacle forms a container with dispensing means.

11. A cash register hood as claimed in claim 1, further comprising product display means attached to the panels for holding and displaying a product.

12. A cash register hood as claimed in claim 11 wherein the product display means includes product dispensing means for dispensing a product.

13. A cash register hood as claimed in claim 11, in which a portion of the front panel is transparent and in which the product display means is located behind said transparent portion of the front panel and within the hood.

14. A cash register hood as claimed in claim 13, includes a product dispensing means forming a shelf and being located behind the product display means.

15. A cash register hood as claimed in claim 12, in which the product dispensing means comprises a receptacle removably attached to the panels.

16. A cash register hood as claimed in claim 15 in which the receptacle is removably attached to an exterior of the hood.

17. A cash register hood as claimed in claim 12, in which said product dispensing means is located above the overhead panel and includes ends which are supported by extensions of the side panels.

18. A cash register hood comprising a base having means to enable the hood to be secured to a supporting surface, a front panel and two side panels fixed to the base, and an overhead panel fixed to the front and side panels, the panels and base defining an enclosure for surrounding a rear, a top and sides of a cash register while leaving a front of the cash register exposed, the overhead panel having one or more depressions integrally formed therein for supporting items such as money, tickets, small purchases etc.

* * * * *